US005906260A

United States Patent [19]

Goodrich

[11] Patent Number: 5,906,260

[45] Date of Patent: May 25, 1999

[54] ANTI-FRAUD COIN CHUTE DEVICE

[75] Inventor: Robert Ray Goodrich, Marion County, Ind.

[73] Assignee: Lucent Technologies Inc., Murray Hill, N.J.

[21] Appl. No.: 08/888,227

[22] Filed: Jul. 3, 1997

[51] Int. Cl.[6] ..... G07F 3/00

[52] U.S. Cl. ..... 194/203; 83/588

[58] Field of Search ..... 194/203; 83/588, 83/600

[56] References Cited

U.S. PATENT DOCUMENTS

| | | | |
|---|---|---|---|
| 371,829 | 10/1887 | Ennis | 194/203 |
| 1,717,079 | 6/1929 | Wheeler | 194/203 |
| 4,254,679 | 3/1981 | Mathey | 83/600 |
| 4,576,275 | 3/1986 | Kobayashi et al. | 194/203 |
| 5,511,645 | 4/1996 | Glueck | 194/203 |

FOREIGN PATENT DOCUMENTS

| | | | |
|---|---|---|---|
| 229238 | 4/1925 | United Kingdom | 83/600 |
| 2201538 | 9/1988 | United Kingdom | 194/203 |

*Primary Examiner*—F. J. Bartuska
*Assistant Examiner*—Bryan J. Jaketic

[57] ABSTRACT

A coin telephone instrument is provided with a string cutter positioned to intercept and cut the string of a tethered coin deposited by a fraudulent user. The deposited, tethered coin follows the usual serpentine path of the coin chute, along a coin chute guide. However, a "cusp" in the coin path facilitates the cutting of the string, when it is pulled back by the fraudulent user. Pulling back on the string causes it to leave the serpentine coin chute path and to enter a gap between the coin chute path and the door of the telephone instrument. The tethered coin remains in the coin chute. Once the string has entered the gap between the door of the telephone instrument it encounters the jaws of the string cutter where any further pulling of the string will cause it to be cut by a scissoring action of the jaws. The coin is then free to continue its normal drop through the coin path, being retained in the coin box safe if genuine or rejected if counterfeit but, in either event, preventing fraudulent use of the coin telephone.

4 Claims, 2 Drawing Sheets

ANTI-FRAUD COIN CHUTE DEVICE

FIELD OF THE INVENTION

This invention relates to coin fraud countermeasures and, more particularly, to the capture and destruction of instruments used to perpetrate coin fraud.

BACKGROUND OF THE INVENTION

A species of coin fraud has arisen in which the miscreant drills a hole through a coin of the type accepted by a coin-operated device, such as a coin telephone instrument, and attaches a flexible cord or string, such as monofilament fishing line, to the coin by threading the string through the drilled hole and knotting the end to tether the coin. The coin is then deposited in the coin slot, the tethered string allowing it to fall through the coin chute of the coin telephone instrument where it triggers the deposited coin registration switch if it is recognized as a genuine coin, or is rejected to the coin return bucket if determined to be counterfeit. In the latter case, the fraudulent user may attach a wad of material to the string and pull it back to jam the mechanism. This blocking of the coin return mechanism prevents subsequent legitimate users from receiving any refund of their misdeposited coins and permits the miscreant to later return to the instrument, unblock its coin return path and receive the fraudulently stored coins. On the other hand, if the coin is recognized as valid, the coin will be held in escrow until a call is placed and has been answered. The fraudulent user, however, hangs up before answer is received, allowing the coin return hopper relay to be activated to return the coin. The fraudulent user now takes up all slack in the string to prevent the coin from returning, but keeping the coin below the release trap so the coin vane will be biased in the coin refund position. A new call may now be placed but, because the tethered string has fouled the apparatus, all deposited coins will be returned to the miscreant at the end of the call. It would be extremely advantageous to be able to frustrate both such fraudulent forms of usage.

SUMMARY OF THE INVENTION

In accordance with the principles of the present invention, in one illustrative embodiment thereof, a coin chute apparatus of the type employed with a coin telephone set, incorporates a string cutter that is positioned to intercept and cut the string of a tethered coin when the string is pulled back after a fraudulent user has deposited a tethered coin in the coin chute. The deposited coin follows the usual serpentine path of the coin chute, along a coin guide. However, in accordance with a feature of the illustrative embodiment, a "cusp" in the coin path causes a portion of the string, when pulled back, to assume a more vertical orientation rather than remaining along the serpentine path of the coin chute proper. Advantageously, the vertical section of the string is allowed to enter a gap between the cover of the coin chute apparatus and its main body where it engages a scissor-like string cutter apparatus, while the tethered coin remains in the coin chute. The string cutter may advantageously be provided with cutting blades held apart by a spring to form a V-shaped jaw-opening that admits the string. When the string is pulled back, it becomes wedged at the apex of the V, causing the blades to be drawn back against the spring. The back of the blade arms move against a guide, causing the jaws to close, scissoring apart the string.

DESCRIPTION OF THE DRAWING

The foregoing and other features of the illustrative embodiment may become more apparent from a reading of the ensuing description, in which.

GENERAL DESCRIPTION

Figure 1:
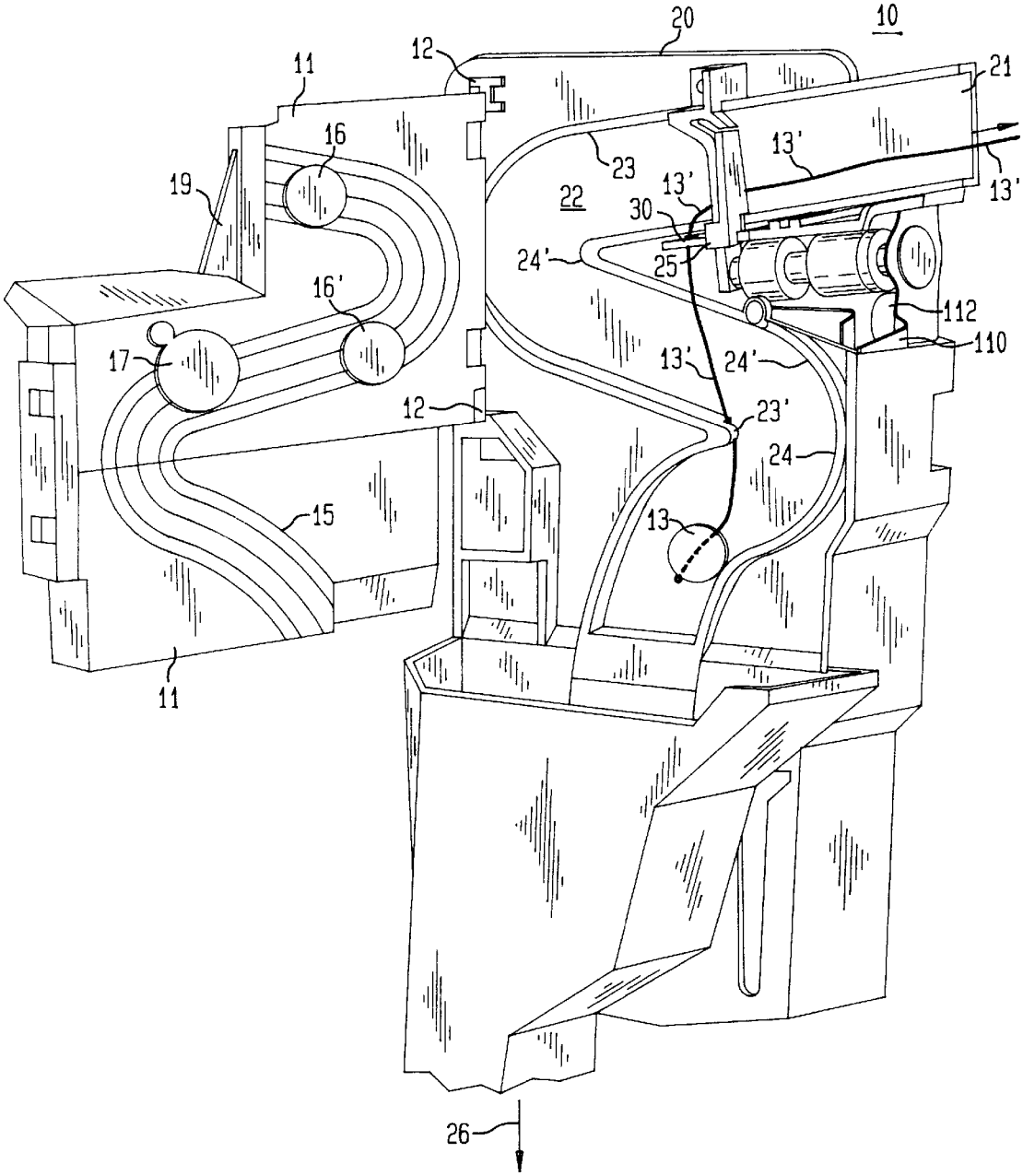
FIG. 1 shows the coin path of a coin telephone with the string cutter of the illustrative embodiment installed.

FIG. 1 shows an isometric view of a coin chute apparatus 10 of a coin telephone set of the type illustrated in U.S. Pat. No. 5,088,587. Coin chute apparatus 10 has a main body 20 and a front door 11 hinged at 12 shown in its swung open position. Main body 20 contains a coin slot 21 into which a coin 13 may be deposited. When deposited in coin slot 21, the coin falls by gravity down a serpentine coin chute path 22 defined by walls 23 and 24 in the main body 20. Articulated cusps 23' and 24' project from walls 23 and 24 respectively. Cusps 23' and 24' cause the coin to drop one or more times in its travel down path 22. At the lower end of path 22, a coin escrow hopper 26 retains the coin pending collection at the end of a predetermined interval under the control of the remote central office (not shown).

The inside surface of door 11 which faces coin path 22 when door 11 is swung to its closed position contains a serpentine wire frame guide 15 which aligns with serpentine coin chute 22 of main body 20. Mounted on wire frame guide 15 are a number of coin validation sensors 16, 16' and 17 which perform their usual functions of ascertaining whether the coins falling through chute 22 are counterfeit or genuine. As described in the aforementioned patent, lever 110 can be operated to release a coin 13 that may have become stuck in track 22. When door 11 is swung to its closed position, a gap will exist between wire frame guide 15 and the front surface of walls 23 and 24. The actuation of lever 110 by means of roller 112 pushes against door 11 to open the door slightly, thereby increasing the aforementioned gap enough to allow the coin to be released.

In accordance with the principles of the illustrative embodiment, the gap between door 11 and main body 20 is put to further use to facilitate the cutting of the string or tether 13' attached to the coin 13 employed by the fraudulent user. The width of the gap is less than the thickness of the thinnest coin allowed to be used by the coin telephone set, but wide enough to admit a string 13', such as a monofilament fishing line preferred fraudulent users. A receptacle 25 is provided in main body 20 adjacent to, but projecting forward of, coin path 22. Receptacle 25 advantageously may be an integral part of the main body 20 and advantageously projects into a mating recess 19 of front door 11, thereby bridging the gap left between main body 20 and door 11 when door 11 is swung shut. A string cutter 30, shown in detail in FIG. 2, is mounted into receptacle 25.

Figure 2:
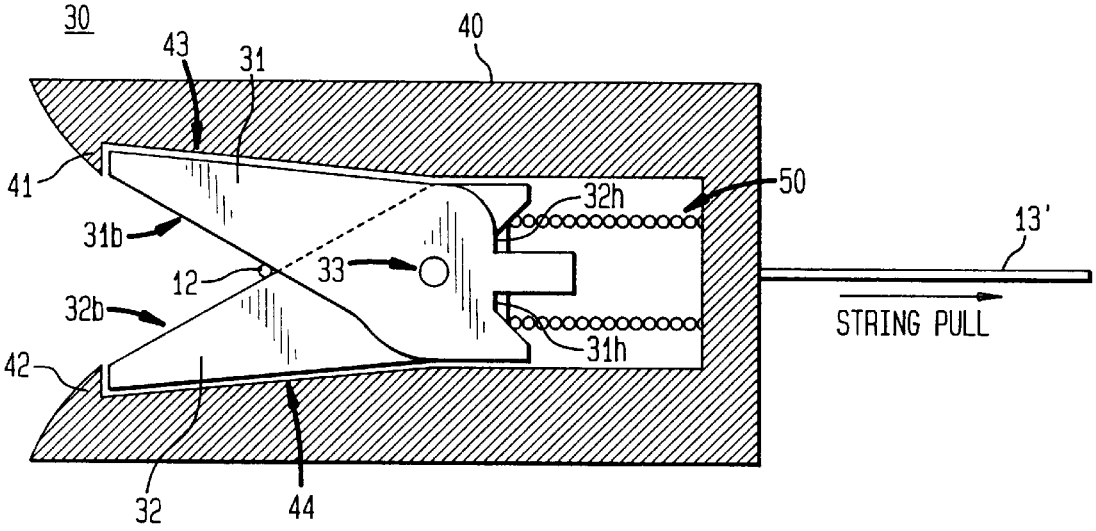
FIG. 2 shows details of the string cutter assembly.

Referring now to FIG. 2, a top view of string cutter 30 is shown. Cutter 30 comprises a frame 40, scissor arms 31, 32, hinge 33 and compression spring 50. Each scissor arm has a respective blade portion 31*b*, 32*b* to the left of pin-hinge 33, and a handle portion 31*h*, 32*h* to the right of hinge 33. Arms 31, 32 are free to move to the left and to the right within frame 40. Compression spring 50 has one end bottomed in frame 40 and its other end adapted to press against handles 31*h*, 32*h*, forcing arms 31, 32 leftward against stop 41, 42 but also apart so that blade portions 31*b*, 32*b* form a V-shaped jaw opening. Into this opening the string tether employed by the fraudulent user and falling into the aforementioned gap will be guided. When the fraudulent user pulls back on string 13', the string, shown in end, cross-sectional view in FIG. 2, will be pulled to the right, causing scissor arms 31, 32 to be moved rightward inside frame 40 compressing spring 50. Frame 40 has ramp members 43, 44 against which the back surfaces of arms 31, 32 glide. When drawn to the right, ramp members 43, 44 causes the open jaws formed by blades 31*b*, 32*b* to close about string 13', cutting it in two. When the string has been cut, spring 50 pressing against handles 31*h*, 32*h* restores the cutter to its initial position.

What has been described is deemed to be illustrative of the principles of the invention, but certain modifications may be apparent to those skilled in the art and may be made without, however, departing from the spirit and scope of the invention.

What is claimed is:

1. A coin chute apparatus having, in combination, a coin chute intended to receive a coin deposited in a coin slot, said chute defining a serpentine path for said coin, and door forming a part of said chute, said door being leverable to release a deposited coin from said chute; the improvement comprising:

a string cutter including a pair of scissor blades forming jaws adapted to cut a string attached to a coin deposited in said slot, and a guide positioned in said path, said guide forming a gap with said door when closed, said gap being thinner than the thinnest coin allowed to be used with said coin chute but wide enough to admit said string; said guide being adapted to direct said string into said gap to actuate said cutter jaws when said string is pulled in a direction opposite to that in which the coin is deposited.

2. An anti-fraud coin chute apparatus for disabling a tethered coin from operating said apparatus, comprising:

a main body having a coin slot for receiving a coin and coin chute having a pair of walls for directing therebetween the gravity-induced fall of said coin along a serpentine path within said main body;

a door hinged to said main body closable to cover said coin chute, said door being leverable to release a coin from said chute, said door when closed leaving a gap between said pair of walls of said chute and said door, said gap being dimensioned to be thinner than the thinnest coin for which said apparatus is to be used; and a cutter interposed in said gap for intercepting and cutting said tether, said cutter including a pair of spring loaded scissor blade jaws adapted to be closed by the pulling of said tether in a direction opposite to that in which said coin is deposited.

3. An anti-fraud coin chute apparatus according to claim 2 wherein said walls include a projecting cusp for directing said string into cutter.

4. An anti-fraud coin chute apparatus according to claim 2 wherein said blades are spring loaded to remain open until said string is directed into said jaw of said cutter.

* * * * *